US005211612A

United States Patent [19]

Carbonero

[11] Patent Number: 5,211,612

[45] Date of Patent: May 18, 1993

[54] ROPE JUMPING STICK

[75] Inventor: Fred L. Carbonero, Rochester Hills, Mich.

[73] Assignee: Pull-Buoy, Inc., Rochester Hills, Mich.

[21] Appl. No.: 619,011

[22] Filed: Nov. 28, 1990

[51] Int. Cl.[5] ..... A63B 5/22

[52] U.S. Cl. ..... 482/81; 482/139; 273/58 C

[58] Field of Search ..... 272/74, 75, 43; 482/81, 482/82, 139; 273/58 C, 29 A, 26 R, 26 E, 58 R, 58 B

[56] References Cited

U.S. PATENT DOCUMENTS

| | | | |
|---|---|---|---|
| 1,826,944 | 10/1931 | McGavin | 272/75 |
| 2,181,979 | 12/1939 | Schaeffer | 272/75 |
| 2,624,157 | 1/1953 | Weeks et al. | 272/75 |
| 2,944,817 | 7/1960 | Stiller | 273/26 |
| 3,110,493 | 11/1963 | Thompson | 272/74 |
| 3,363,898 | 1/1968 | Crovello | 272/75 |
| 3,419,269 | 12/1968 | Saffer | 272/74 |
| 3,528,654 | 9/1970 | Larson et al. | 272/74 |
| 3,601,398 | 8/1971 | Brochman | 273/58 C X |
| 3,907,287 | 9/1975 | Fox | 273/26 E |
| 4,186,921 | 2/1980 | Fox | 273/58 C X |

FOREIGN PATENT DOCUMENTS

| | | | |
|---|---|---|---|
| 0593756 | 3/1960 | Canada | 272/74 |
| 1053167 | 3/1952 | France | 272/74 |
| 1035922 | 4/1953 | France | 272/74 |
| 1043017 | 9/1966 | United Kingdom | 272/75 |
| 1400005 | 7/1975 | United Kingdom | 272/74 |

*Primary Examiner*—John J. Wilson
*Assistant Examiner*—L. Thomas
*Attorney, Agent, or Firm*—Reising, Ethington, Barnard, Perry & Milton

[57] ABSTRACT

A rope jumping stick assembly (10) for recreational use comprising a stick assembly (12) and a cord (20). The stick assembly (12) comprises a handle portion (18) having a first and second end; a cup (14) covering the first end of the handle portion (18) and a cap (17) covering the second end. The cup (14) comprises a hole (16). The cord (20) having a first and second end attaches to the stick assembly (12) by passing the first end through the hole (16) in the cup (14) and forming or fixing an enlargement (22) on the first end of the cord (20). Then the cup (14) is placed over the first end of the handle portion (18), and the cord (20) is thereby fixed to the stick assembly (12). The assembly (10) includes a whiffle ball (30) attached to the second end of the cord (20).

6 Claims, 1 Drawing Sheet

ROPE JUMPING STICK

TECHNICAL FIELD

The subject invention relates to rope jumping stick recreational assemblies comprising a stick, a flexible cord attaching to the stick and possibly a weighted object attached to the free end of the cord.

BACKGROUND OF THE INVENTION

The general practice of attaching a stick and a ball with a flexible string or cord for producing a recreational device has appeared in United States patents as early as 1894. Rope jumping sticks of this type are generally used for recreation and for developing coordination and muscle tone.

In using a rope jumping stick, an operator grasps the end of the stick away from the end which connects to the cord. The operator manipulates the stick in such a way that the end of the cord sweeps out the circumference of a circle on the ground in front of the operator, and in such a way that the center of the circle is roughly at the end of the stick connected to the cord. A few participants stand around the path of the cord and jump when the cord passes through the respective positions where the participants stand.

Contemporary toy manufacturers are concerned primarily with the production cost and safety of their toys. Manufacturers favor toys which are inexpensive to manufacture and ship. Manufacturers also favor toys which are unlikely to produce injury to persons using the toy. U.S. Pat. No. 2,181,979 to Shaeffer, U.S. Pat. No. 2,944,817 to Stiller and U.S. Pat. No. 3,419,269 to Saffer disclose rope jumping stick assemblies which appear unnecessarily complicated and therefore costly to produce. The U.S. Pat. No. 512,815 to Demler is simple in design: however; its solid rod and solid ball may pose some injury risk to persons operating the assembly.

SUMMARY OF THE INVENTION AND ADVANTAGES

According to the present invention, there is provided a rope jumping stick of the type used recreationally. The assembly comprises an elongated, cylindrical handle portion having a first end and a second end. The assembly further includes a cup having a telescoping portion for telescoping engagement along the first end of the handle portion, a covering portion for covering the first end of the handle portion and a hole located on the covering portion of the cup. The assembly also includes a flexible cord having a first end and a second end, with the first end attached to the first end of the handle portion by passing the first end through the hole in the cup. The rope jumping stick assembly is characterized by the cord having an enlargement on the first end for preventing the first end from passing through the hole in the cup in order to retain the cord attached to the cup to the handle portion.

One advantage of the present invention derives from its simplicity. The assembly can be made from as few as four parts. Since the parts themselves are simple and easy to produce, and since the parts can be made of inexpensive, durable and light weight plastic, the assembly can be very inexpensive to produce and ship.

Another advantage of the invention is its safety. Since the assembly is produced from light weight flexible plastic, the assembly poses a very low injury risk.

FIGURES IN THE DRAWINGS

DETAILED DESCRIPTION OF THE PREFERRED EMBODIMENT

Figure 2:
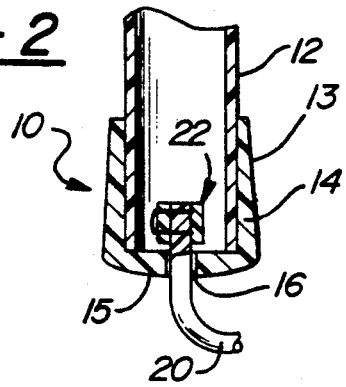
FIG. 2 is a fragmentary cross-sectional view of the stick end taken along line 2—2, showing the cord attached to the stick.
Figure 3:
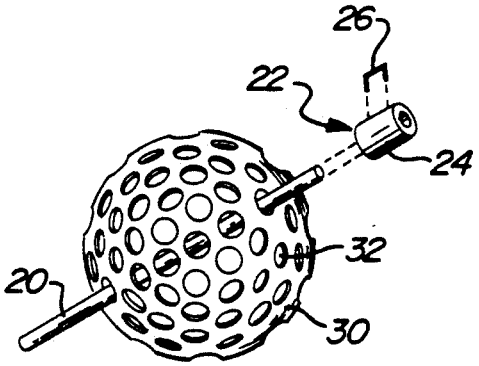
FIG. 3 is a partially exploded side view of the ball showing a proposed manner of attaching the cord to the ball.
Figure 4:
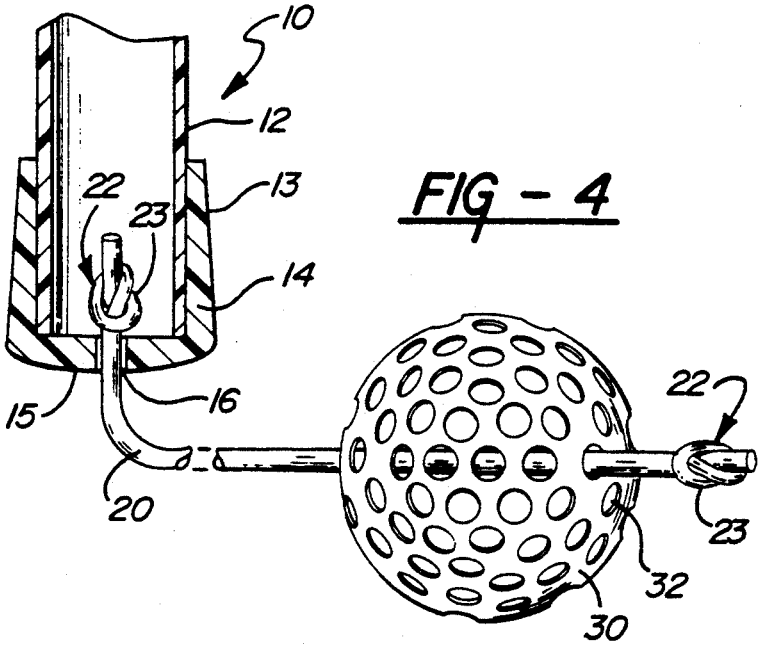
FIG. 4 is a side view of the assembly with a fragmentary cross-section of the stick.
Figure 1:
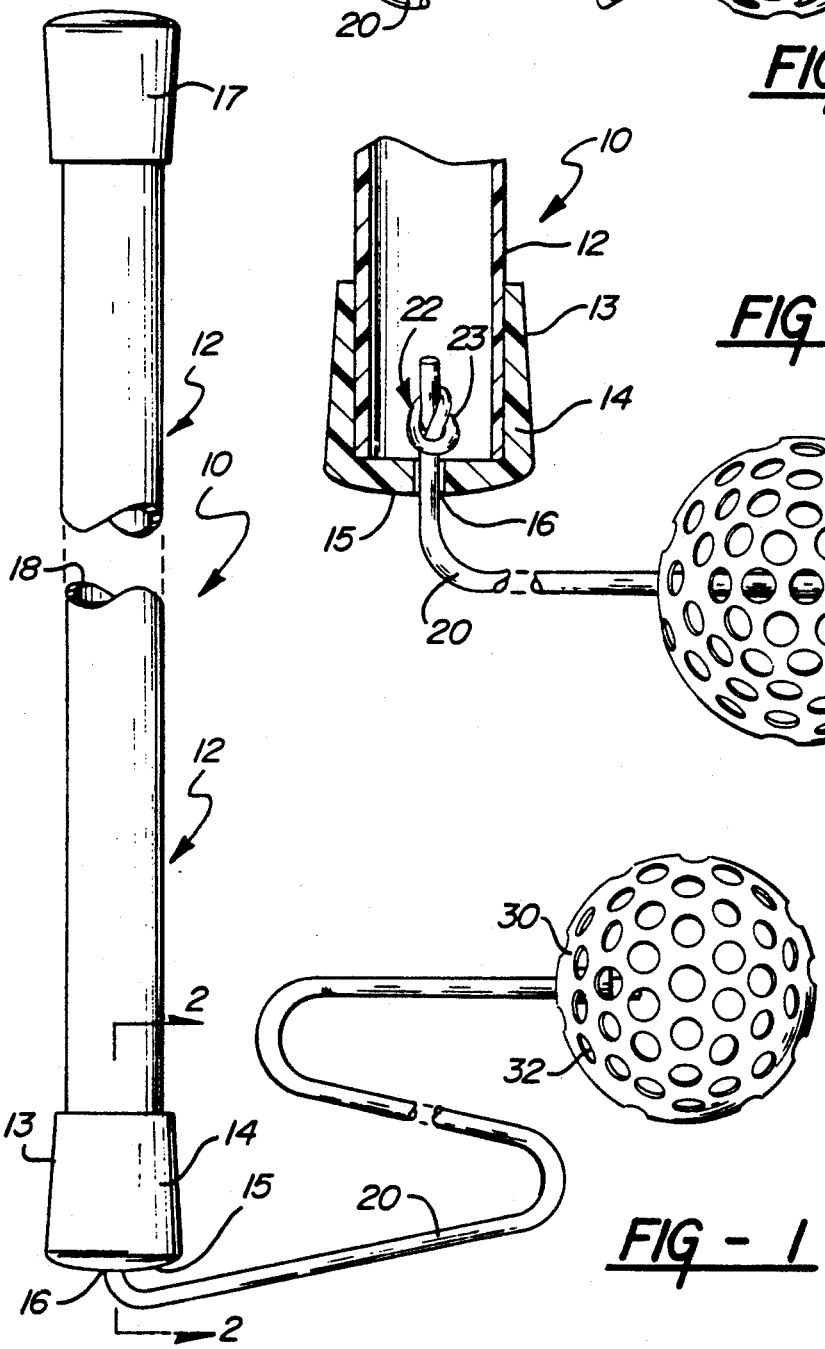
FIG. 1 is a side view of the rope jumping stick assembly.

A rope jumping stick assembly of the type for recreational use is generally shown at 10 in the figures. The assembly 10 generally includes a stick assembly 12 and a cord 20.

The stick assembly 12 includes a handle portion or stick 18 a cup 14 and a cap 17. The handle portion 18 is substantially a hollow plastic cylinder having a first and second end. The cup 14 is placed over the first end of the handle portion 18. The cap 17 is placed over the second end of the handle portion 18. The cup 14 and cap 17 are generally plastic or rubber. The cup 14 and the cap 17 each have a telescoping portion 13 and a covering portion 15. The telescoping portion 13 engages telescopically with the handle portion 18. The covering portion 15 covers an open end of the hollow cylindrical handle portion 18. The cup 14 has a hole 16 positioned on its covering portion 15 as shown in the Figures. The diameter of the hole 16 is slightly greater than the thickness of the cord 20.

The cord 20 is generally a solid flexible piece of plastic. A cross-section of the cord 20 is usually circular, although this is not necessarily the case. The length of the cord 20 may vary, but is usually under three feet. The cord 20 has a first and second end. The first end of the cord 20 attaches to the handle portion 18 by securing the first end of the cord 20 to the cup 14 and, in turn by securing the cup 14 to the handle portion 18. The cord 20 is secured to the cup 14 by passing the first end of the cord 20 through the hole 16 of the cup and by fixing or forming an enlargement 22 to the first end of the cord 20. Because the enlargement 22 has a diameter greater than the diameter of the hole 16, the first end of the cord 20 cannot be pulled through the hole 16 in the cup 14. The cup 14 is then disposed over one end of the tube 18 and the cord 20 is thereby attached to the handle portion 18.

The rope jumping stick assembly 10 may be complete as specified. However, it is often desirable to attach a weighted object 30 to the second end of the cord 20.

The rope jumping stick assembly 10 may further include a ball 30. The ball 30 is generally a hollow plastic whiffle TM ball having a plurality of holes 32 for allowing air to pass through the ball. The holes 32 have a diameter slightly greater than the thickness of the cord 20. The ball 30 is attached to the cord 20 by passing the second end of the cord through one of the holes 32 in the ball 30 and through a second hole 32 in the ball 30 so that the second end of the cord is outside of the ball. An enlargement 22 is then fixed or formed around the second end of the cord 20. The enlargement 22 has a thickness greater than the diameter of the holes 32. Finally, the second end of the cord 20 with the enlargement 22 attached is forced back through the second hole 32 so that the second end of the cord with the enlargement 22 attached is inside the ball. The holes 32 are sufficiently resilient to allow the enlargement 22 to be forced through them although the enlargement is larger than the holes. However, the holes 32 are rigid enough to retain the enlargement inside the ball with normal use of the rope jumping stick assembly 10. The second end of the cord 20 is thus prevented from being removed from the first hole 32 through which the cord 20 is passed.

One embodiment of the enlargement 22 is a piece of tubing 24 having an inner diameter which equals the diameter of the cord 20 and an outer diameter larger than the diameter of the holes 16, 32 through which the cord passes. The tubing 24 telescopingly engages over an end of the cord 20 and is secured to that end of the cord with a staple 26. A second embodiment .of the enlargement 22 involves simply tying a knot 23 in the end of the cord 20.

Obviously, many modifications and variations of the present invention are possible in light of the above teachings. It is therefore to be understood that within the scope of the appended claims wherein reference numerals are merely for convenience and are not to be in any way limiting, the invention may be practiced otherwise than is specifically described.

The embodiments of the invention in which an exclusive property or privilege is claimed are defined as follows:

1. A rope-skipping assembly comprising: a length of plastic tube (18) having a constant diameter extending between first and second open ends; a cap (17) covering said first end; a cup (14) having a telescoping portion (13) for telescoping engagement along said second end and a covering portion (15) for covering said second end, said covering portion (15) having a cup hole (16) therein; a hollow plastic ball (30) having a plurality of holes (32) through said ball; a cord (20) joining said ball (30) to said tube (18) and having a first end passing through said cup hole (16) in said cup (14) with an enlargement (22) thereon for preventing said first end of said cord (20) from passing back through said cup hole (16) and thereby retaining said core (20) to said cup (14), said cord also having a second end passing through one hole of said plurality of holes (32) in said ball (30) and having an enlargement (22) formed thereon for preventing said second end of said cord (20) from passing back through said hole (32) for retaining said ball (30) to said cord;

characterized by said enlargement (22) including a length of hollow plastic tube (24) having an inner diameter which equals the thickness of said cord (20) and an outer diameter larger than both said cup hole (16) and one of said plurality of holes (32), said enlargement (22) telescopingly disposed over said cord.

2. An assembly as set forth in claim 1 further characterized by including securing means (26) for securing said enlargement (22) to said cord.

3. An assembly as set forth in claim 2 further characterized by said securing means comprising a staple (26) passing through said hollow tube (18) and said cord (20).

4. An assembly as set forth in either claim 1 or 3 further characterized by said cord (20) being a solid plastic cord.

5. An assembly as set forth in claim 1 further characterized by said cup (14) and said cap (17) being plastic.

6. An assembly as set forth in claim 1 further characterized by said enlargement (22) including a knot (23) formed in one of said ends of said cord (20).

* * * * *